US005122078A

United States Patent [19]

Davis et al.

[11] Patent Number: 5,122,078

[45] Date of Patent: Jun. 16, 1992

[54] HIGH DENSITY RIBBON CABLE CONNECTOR

[75] Inventors: Wayne S. Davis, Harrisburg; Robert N. Whiteman, Jr., Middletown, both of Pa.

[73] Assignee: AMP Incorporated, Harrisburg, Pa.

[21] Appl. No.: 595,636

[22] Filed: Oct. 5, 1990

Related U.S. Application Data

[63] Continuation of Ser. No. 359,231, May 31, 1989, abandoned.

[51] Int. Cl.[5] ..... H01R 4/24

[52] U.S. Cl. ..... 439/405; 439/751

[58] Field of Search ..... 439/391–407, 439/741, 751

[56] References Cited

U.S. PATENT DOCUMENTS

| | | | |
|---|---|---|---|
| 3,820,055 | 6/1974 | Huffnagle et al. . | |
| 4,068,912 | 11/1978 | Hudson, Jr. et al. . | |
| 4,252,397 | 2/1981 | Eigenbrode et al. . | |
| 4,359,257 | 11/1982 | Lopinski et al. . | |
| 4,475,786 | 10/1984 | Root et al. . | |
| 4,671,596 | 6/1987 | Soma | 439/404 |
| 4,693,533 | 9/1987 | Szczesny et al. . | |
| 4,753,608 | 6/1988 | Yamaguchi | 439/395 |
| 4,773,876 | 9/1988 | Nakamura et al. . | |
| 4,781,615 | 11/1988 | Davis et al. . | |
| 4,808,125 | 2/1989 | Waters et al. . | |

*Primary Examiner*—David L. Pirlot
*Attorney, Agent, or Firm*—David L. Smith

[57] ABSTRACT

A high density electrical connector for terminating to conductors of a ribbon cable has an insulative housing defining a cable receiving face, a mating face and at least one row of terminal receiving passages extending therebetween with terminals secured therein. The terminal receiving passages open into opposing channels near the cable receiving face. Each terminal includes a mating portion, an intermediate section and an insulation displacement plate. The intermediate section is defined by a pair of sheared edges extending toward the insulation displacement plate from the mating section. The intermediate section includes a notched region defining a first shoulder and an insert sheared edge. The intermediate section further includes a lateral offset formed such that the mating portion is perpendicular to the insulation displacement plate. The first shoulder, a portion of the intermediate section and the insulation displacement plate are received in a channel near the cable receiving face. The first shoulder and insert sheared edge are adapted to be a predetermined spacing from any part of an adjacent contact.

35 Claims, 6 Drawing Sheets

HIGH DENSITY RIBBON CABLE CONNECTOR

This application is a continuation of application Ser. No. 07/359,231 filed May 31, 1989, now abandoned.

BACKGROUND OF THE INVENTION

This invention relates to electrical connectors and, in particular, to a high density ribbon cable connector wherein a predetermined minimum spacing is maintained between all features of any contact and other nearby contacts.

Ribbon cable connectors for mass terminating to ribbon cable at a location remote from an end of the cable, such as in a daisy chain configuration, are disclosed in U.S. Pat. Nos. 3,820,055; 4,068,912; 4,475,786; and 4,693,533. As the downsizing of electronic devices has progressed, more contacts are placed in smaller and smaller connectors to consume less space on a printed circuit board. The complementary connectors, typically a cable connector, must also contain a higher density of contacts. As the density of contacts in ribbon cable connectors increases, the spacing between adjacent conductors in ribbon cable adapted to be terminated to the ribbon cable connector decreases correspondingly. Typically, the interconductor spacing is reduced to one-half of the spacing of the previous generation cable. As the spacing between ribbon cable connectors decreases, positioning contacts in a connector housing at an appropriate spacing, separated by dielectric material while positioning insulation displacements plates in an array appropriate for mass termination to the ribbon cable has become more critical. Small variations in the positioning of contacts in the housing or movement of contacts during termination of the ribbon cable can cause shorting between adjacent conductors. Due to the closeness of spacing of the contacts, greater attention must be paid than in the past to the sufficiency of dielectric material or air space separating the closest portions of adjacent contacts to assure that the contacts can withstand voltage levels sufficient to make the connector of practical use.

SUMMARY OF THE INVENTION

In accordance with the present invention, a high density electrical connector for terminating to conductors of a ribbon cable has an insulative housing defining a cable receiving face, a mating face and at least one row of terminal receiving passages extending therebetween with terminals secured therein. The terminal receiving passages open into opposing channels near the cable receiving face. Each terminal includes a mating portion, an intermediate section and an insulation displacement plate. The intermediate section is defined by a pair of sheared edges extending toward the insulation displacement plate from the mating section. The intermediate section includes a notched region defining a first shoulder and an inset sheared edge. The intermediate section further includes a lateral offset formed such that the mating portion is perpendicular to the insulation displacement plate. The first shoulder, a portion of the intermediate section and the insulation displacement plate are received in a channel near the cable receiving face. The first shoulder and inset sheared edge are adapted to be a predetermined spacing from any part of an adjacent contact.

DESCRIPTION OF THE PREFERRED EMBODIMENT

Figure 1:
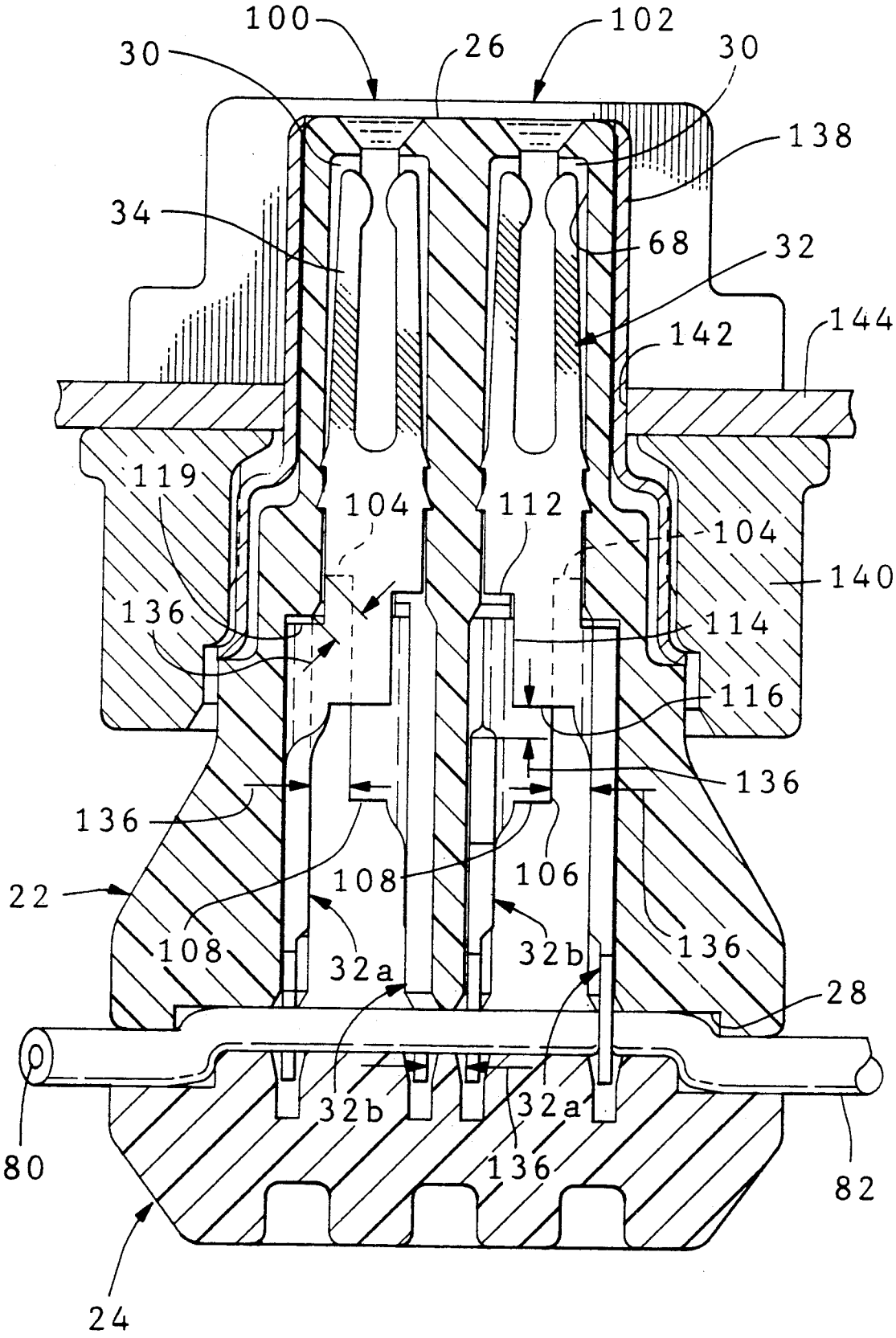
FIG. 1 is an offset cross-sectional view of a ribbon cable connector in accordance with the present invention mounted to a panel and terminated to a ribbon cable.
Figure 8:
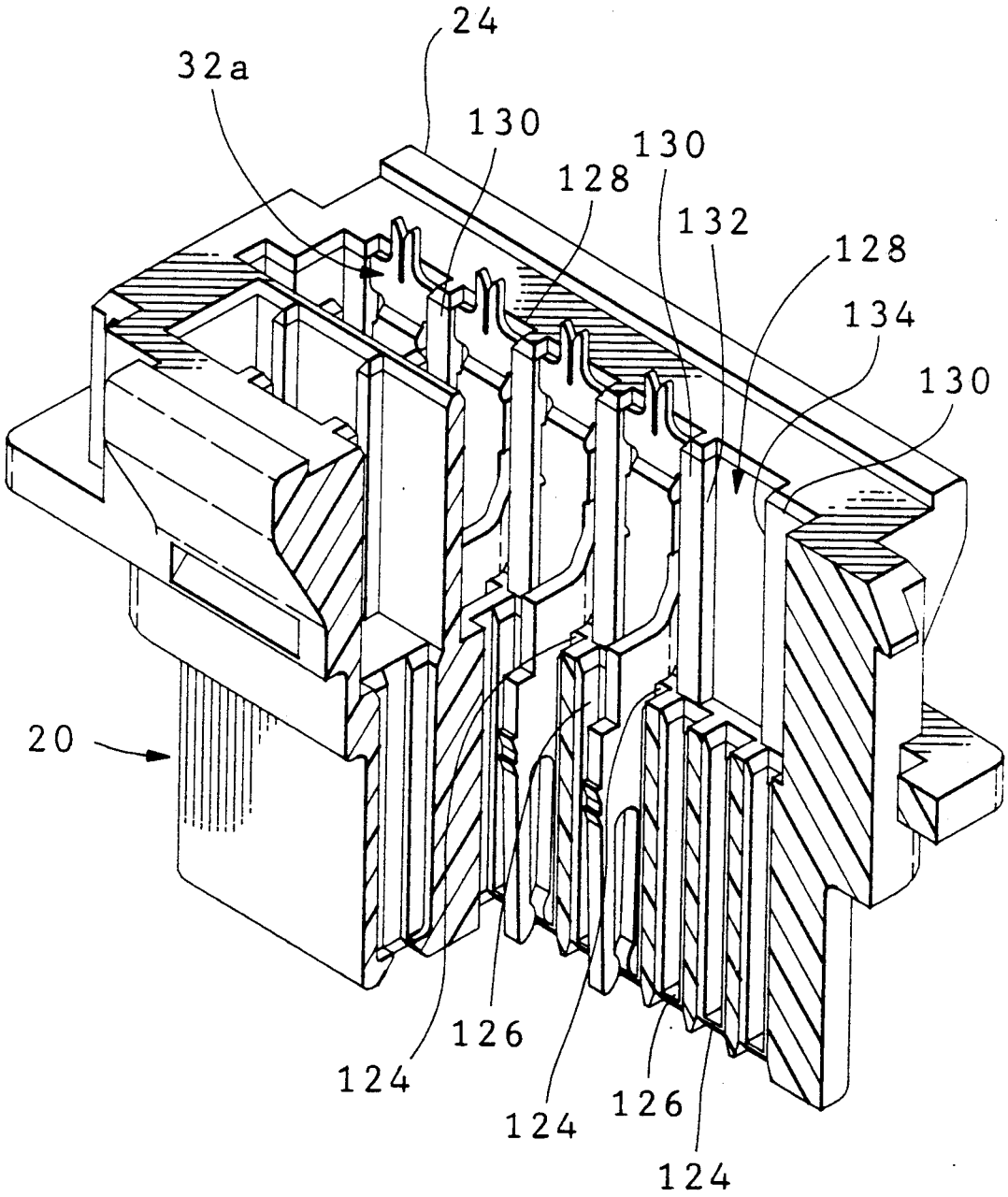
FIG. 8 is a perspective view, partially in section, of the ribbon cable connector.

A high density ribbon cable connector 20, in accordance with the present invention, is shown in a cross-sectional view in FIG. 1. Although connector 20 is shown as a shielded connector, connector 20 could be unshielded, as shown in FIG. 8. Connector 20 includes housing 22 and termination cover 24, both molded of a dielectric material. In a preferred embodiment, housing 22 and termination cover 24 are molded of a plastic material having substantially no shrink rate such as a liquid crystal polymer sold under the tradename "Vectra-130."

Housing 22 has a forward mating face 26, opposed conductor receiving face 28 and contact receiving passages 30 extending therebetween, with contacts 32 secured therein. In the preferred embodiment, contacts 32 are positioned in housing 22 with the mating portion 34 in the form of receptacle 36 in two rows spaced with centerline 0.100 (2.5 mm) apart; adjacent receptacles in each row are spaced with centerlines 0.050 inch (1.27 mm) apart, and connector 20 is designed to terminate a ribbon cable having 0.025 inch (0.635 mm) centerline spacing between conductors.

Figure 2:
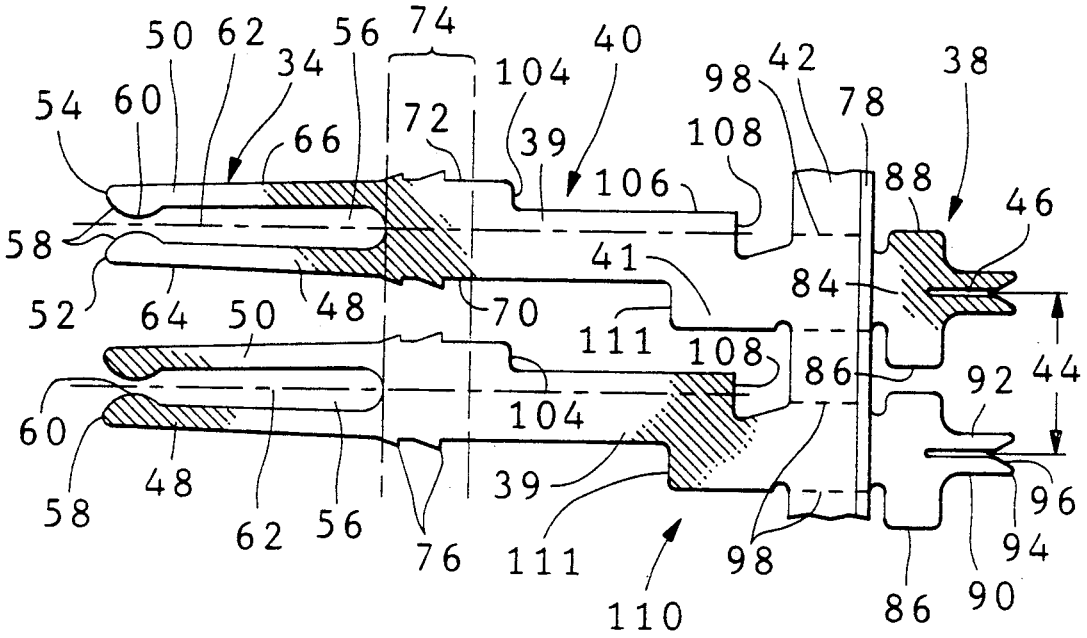
FIG. 2 is a plan view of two adjacent inside contacts as stamped on a carrier strip.
Figure 3:
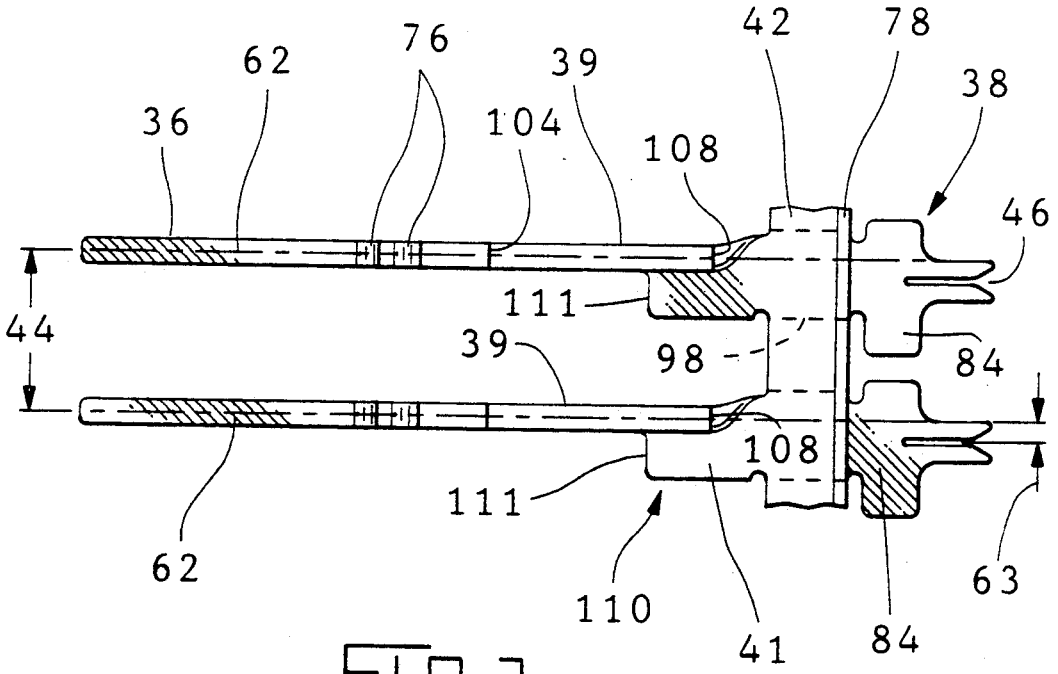
FIG. 3 is a plan view of the two adjacent inside contacts of FIG. 2 with the receptacle of each formed perpendicular to the plane of the insulation displacement plate.

Contacts 32, as best seen in FIGS. 2–7, are stamped and formed from rolled strip stock, typically phosphorous bronze. A portion of the width of the rolled stock is premilled to provide a thinner region along an edge of the strip stock. Each contact 32 has a mating portion 34 at one end, an insulation displacement plate 38 at the other end, and a intermediate portion 40 therebetween. Mating portion 34 of each contact is stamped in the thicker portion of the stock. The insulation displacement plate 38 is stamped in the thinner region of the stock. As best seen in FIGS. 2, 3, 5 and 6, contacts 32 are stamped on the same centerline spacing as they will be received in housing 22. FIGS. 2, 3, 5 and 6 show contacts 32 stamped and formed with their relative positions maintained by a carrier strip 42. The spacing 44 between the insulation displacement slots 46 (FIG. 2)

of adjacent contacts 32 is 0.100 inch (2.5 mm) as is the centerline spacing of the formed receptacle 36 (FIG. 3). Mating portion 34 in the form of receptacle 36 is comprised of a pair of opposed cantilever beams 48,50 extending forwardly from intermediate portion 40 to free ends 52,54 and define therebetween tab receiving slot 56. Free ends 52,54 are tapered inwardly toward tab receiving slot 56 at taper 58 to assist in guiding a tab of a complementary connector (not shown) in to slot 56. Curved surfaces 60 provide a surface for a tab to engage. In a preferred embodiment, receptacle 36 is substantially symmetrical about centerline 62.

Outer sheared surfaces 64,66 of beams 48,50 taper gradually away from the centerline 62 in a direction from free ends 52,54 toward intermediate portion 40. As best seen in FIG. 1, should surfaces 64 or 66 engage a wall 68 of contact receiving passage 30, the wall functions as an anti-overstress feature. The outer sheared edge surfaces 70,72 through regions 74 of intermediate portions 40 are also symmetrical about centerline 62 and may be parallel. Barbs 76 on intermediate portion 40 extend beyond side edges 70,72. Upon insertion of contact 32 into passages 30, barbs 76 plow through passage walls 68 with plastic flowing around the barbs to provide an interference fit that secures contact 32 in passage 30.

Figure 6:
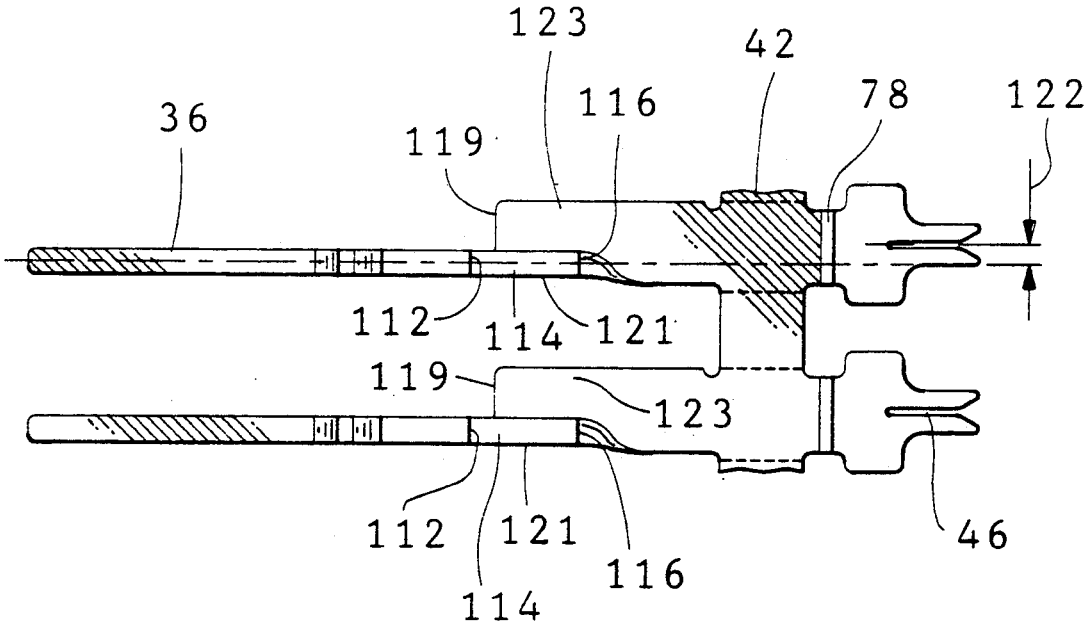
FIG. 6 is a plan view of the two adjacent outside contacts of FIG. 5 with the receptacle portion of each formed perpendicular to the plane of the insulation displacement plate.

Insulation displacement plate 38 is fabricated in the thinner, premilled portion of the stock, with taper 78 defining the transition between the thicker and thinner portions of the stock. Insulation displacement plate 38 is thinner to facilitate insulation displacement termination of conductors 80 of ribbon cable 82 by reducing the force necessary to effect a termination. Insulation displacement plate 38 has a widened base region 84, the sides of which are defined by precisely spaced shear edges 86,88. A pair of spaced insulation piercing tines 90,92 extend rearwardly from base region 84 to insulation piercing points 94 at the distal ends and define conductor receiving slot 46 therebetween. Tapered lead-in surfaces 96 angle toward conductor receiving slot 46. Slot 46 extends into widened base region 84 of plate 38, with the base region 84 beginning about half way along slot 46. As best seen in FIGS. 3 and 6, slot 46 is substantially parallel to centerline 62 and laterally displaced therefrom at lateral spacing 63. Contacts 32 are severed from carrier strip 42 as indicated by broken line 98.

Figure 5:
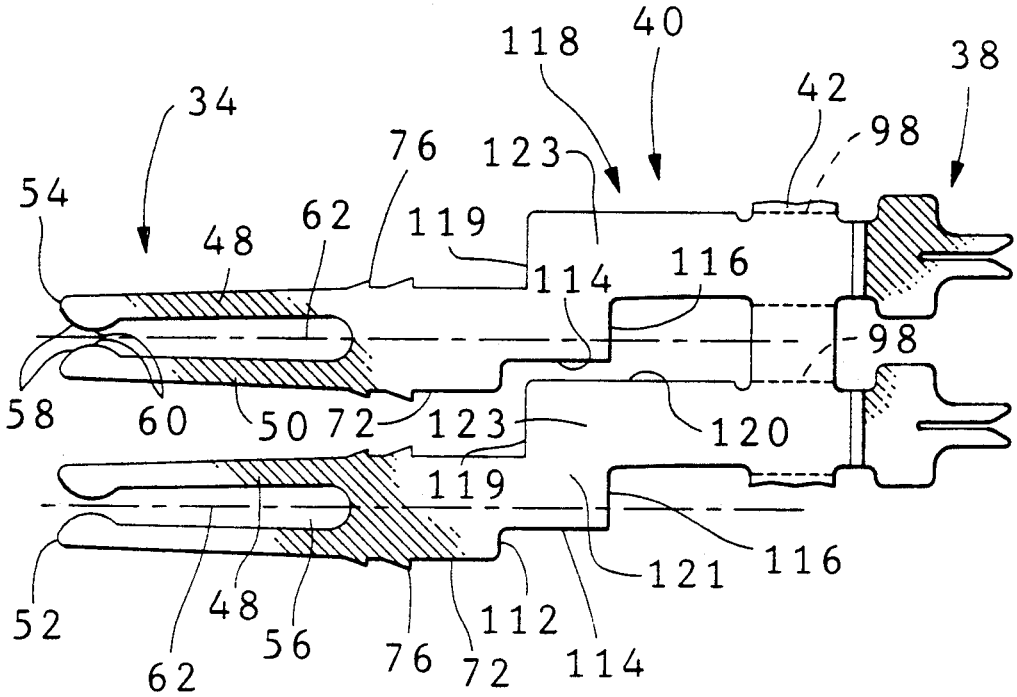
FIG. 5 is a plan view of two adjacent outside contacts as stamped on a carrier strip.
Figure 4:
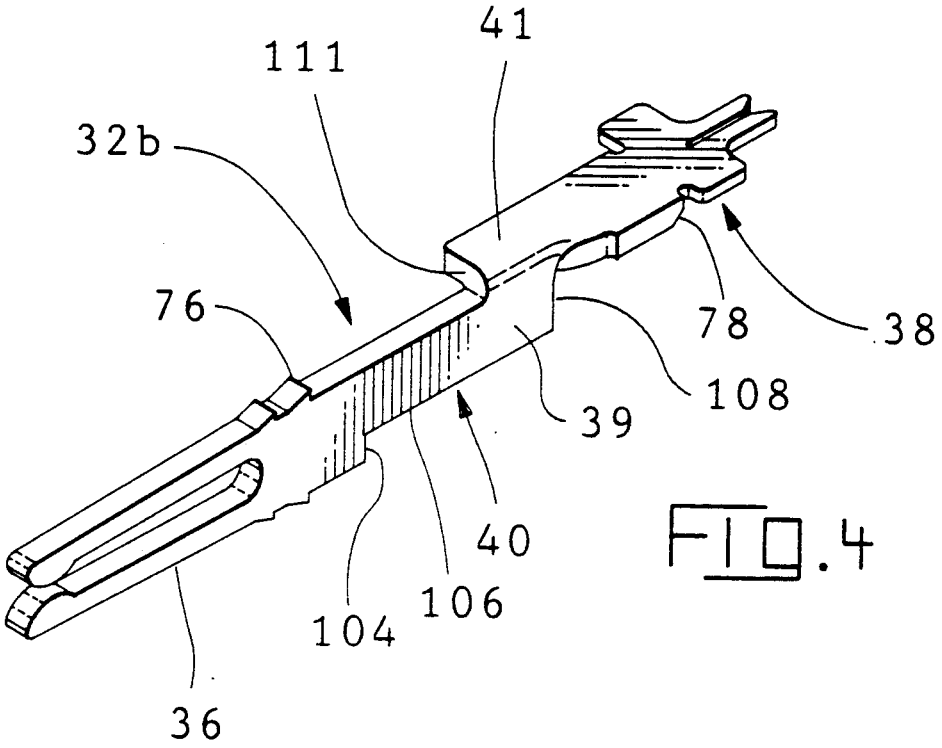
FIG. 4 is a perspective view of an inside contact.
Figure 7:
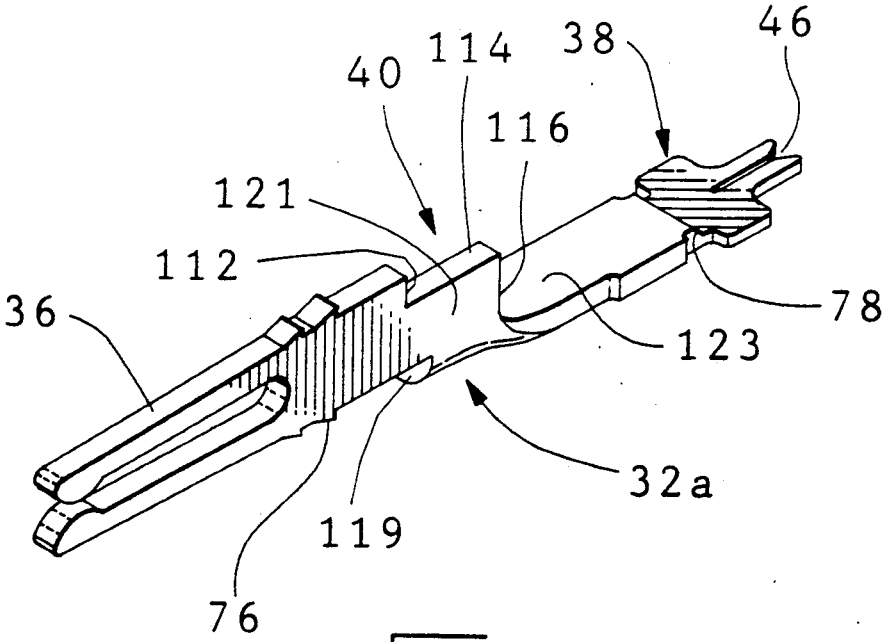
FIG. 7 is a perspective view of an outside contact.
Figure 9:
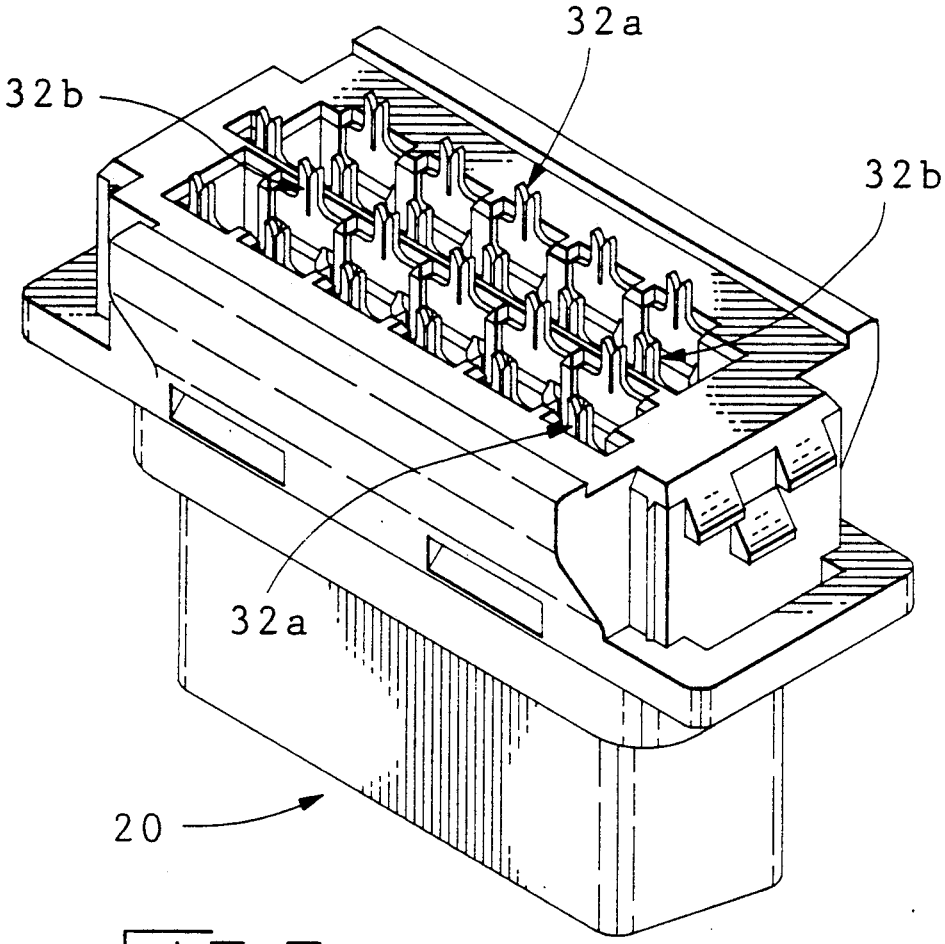
FIG. 9 is a perspective view of the ribbon cable connector.

As best seen by comparing FIGS. 2, 3 and 4 to FIGS. 5, 6 and 7, respectively, there are two types of contacts 32 with the general features described above. The two contacts are designated either outside or inside. Contact **32*a* will be referred to as an outside contact because the insulation displacement plates 38 of contacts 32*a* form the two outer rows of insulation displacement plates, as best seen in FIGS. 1, 8 and 9. Contacts 32*a* are also shown in FIGS. 5, 6 and 7. Contacts 32*b* will be referred to as inside contacts because insulation displacement plates 38 of contacts 32*b* form the two inner rows of insulation displacement plates, as best seen in FIGS. 2, 3 and 4 contacts 32*a* and 32*b* are substantially the same overall length as best seen in FIG. 1**.

The mating portion 34 of outer row of contacts **32*a* and the mating portion of adjacent inner row of contacts 32*b* alternately interdigitate to form a first row 100 of receptacles 36 across the width of connector 20. Similarly, the mating portion of the other outer row of contacts 32*a* and the mating portion of the adjacent inner row of contacts, 32*b* alternately interdigitate to form a second row 102 of receptacles across the width of connector 20**.

With reference to FIGS. 2, 3 and 4, inside contact **32*b* is shown. In FIG. 2, adjacent contacts 32*b* are shown stamped on centerline, integral with carrier strip 42. The entire contact, prior to forming, is substantially in the plane of the original stock. Sheared surface 72 has been notched out of intermediate portion 40 forming shoulder 104 and sheared surface 106. The location of shoulder 104 and the depth of the notch forming sheared surface 106 are both predetermined as discussed below. Shoulder 108 extends on both sides of centerline 62 and provides a rearward facing insertion shoulder on which an insertion force can be applied, on both sides of centerline 62 to overcome the resistance to insertion provided by barbs 76 engaging wall 68, to insert contact 32*b* into passage 30 during manufacture of connector 20. Since the insertion force can be applied to shoulder 108 on both sides of centerline 62, there is no moment to rotate the receptacle. Lateral offset section 110 is within intermediate portion 40 of contact 32*b*. A first portion 39 of lateral offset section 110 is rearward of mating portion 34, defines shoulder 108 and forward edge 111. A second portion 41 of lateral offset section 110 is contiguous with first portion 39 and interconnects with insulation displacement plate 38. Contact 32*b* is formed through lateral offset section 110 such that mating portion 34 is in a plane substantially perpendicular to the plane of insulation displacement plate 38. First portion 39 substantially remains in the plane of mating portion 34; second portion 41 substantially remains in the plane of insulation displacement plate 38**.

FIG. 3 shows inside contacts **32*b* with receptacle 36 and first portion 39 formed to be perpendicular to insulation displacing plate 38 and second portion 41. In this formed position of the preferred embodiment, the centerline of receptacle 36 is laterally offset from the centerline of slot 46 at lateral offset 63 by half of the centerline spacing of the conductors 80 of cable 82 adapted to be terminated to connector 20**.

In FIG. 5, adjacent contacts **32*a* are shown stamped on centerline, integral with carrier strip 42. The entire contact, prior to forming, is substantially in the plane of original stock. Sheared surface 72 of contacts 32*a* has been notched out of intermediate portion 40 forming shoulder 112 and sheared surface 114. The location of shoulder 112 and the depth of the notch forming sheared surface 114** are both predetermined, as discussed below.

Shoulder 116 extends on both sides of centerline 62 and provides a rearward facing insertion shoulder on which an insertion force can be applied. The insertion force is applied on both sides of centerline 62 to overcome the resistance to insertion provided by barbs 76 engaging wall 68, to insert contact **32*a* into passage 30 during manufacture of connector 20. Since the insertion force can be applied to shoulder 116 on both sides of centerline 62, there is no moment to rotate the receptacle. Shoulders 108 and 116 are displaced along centerline 62 of contacts 32*b* and 32*a* such that one of the insertion shoulders is more forward than the other. In the preferred embodiment, shoulder 116 is more forward on contact 32*a* than shoulder 108 is on contact 32*b*. Thus, outside contacts 32*a* may be mass inserted with a tool pushing on shoulder 116; subsequently, inside contacts 32*b* may be mass inserted with a tool pushing on shoulder 108. In this sequence, the tool used to insert contacts 32*b* does not interfere with shoulder 116**.

Lateral offset section 118 is within intermediate portion 40 of contact 32*a*. A first portion 121 of lateral offset section 118 is rearward of mating portion 34, defines shoulder 116 and forward edge 119. A second portion 123 of lateral offset 118 is contiguous with first portion 121 and extends rearward through carrier strip 42 to interconnect with insulation displacement plate 38. Contact 32*a* is formed through lateral offset section 118 such that mating portion 34 is in a plane substantially perpendicular to the plane of insulation displacement plate 38. First portion 121 substantially remains in the plane of mating portion 34; second portion 123 substantially remains in the plane of insulation displacement plate 38. Lateral offset section 118 has a shear edge 120 that is within the profile of mating portion 34 of the adjacent contact in that sheared edge 120 falls within the notch formed by shoulder 112 and sheared surface 114.

FIG. 6 shows outside contacts 32*a* with receptacle 36 and part of intermediate portion 40 forward of shoulder 116 formed to be perpendicular to insulation displacing plates 38 and second portion 23. In this formed position of the preferred embodiment, the centerline of receptacle 36 is laterally offset from the centerline of slot 46 at 122 by half of the centerline spacing of the conductors 80 of cable 82 adapted to be terminated to connector 20. In this manner, as shown best in FIG. 9, the slots for receiving conductors 80 are staggered in connector 20 such that each conductor terminates to a predetermined contact, as is known in the art.

As best seen in the partial sectional view of FIG. 8, the receptacle portion of outside contacts 32*a* are received in every other receptacle receiving passage 124, of passages 30, in a row of receptacles 100 or 102. The receptacle portion of inside contacts 32*b* are received in the remaining receptacle receiving passages 126, of passages 30, in a row of receptacles 100 or 102.

Figure 10:
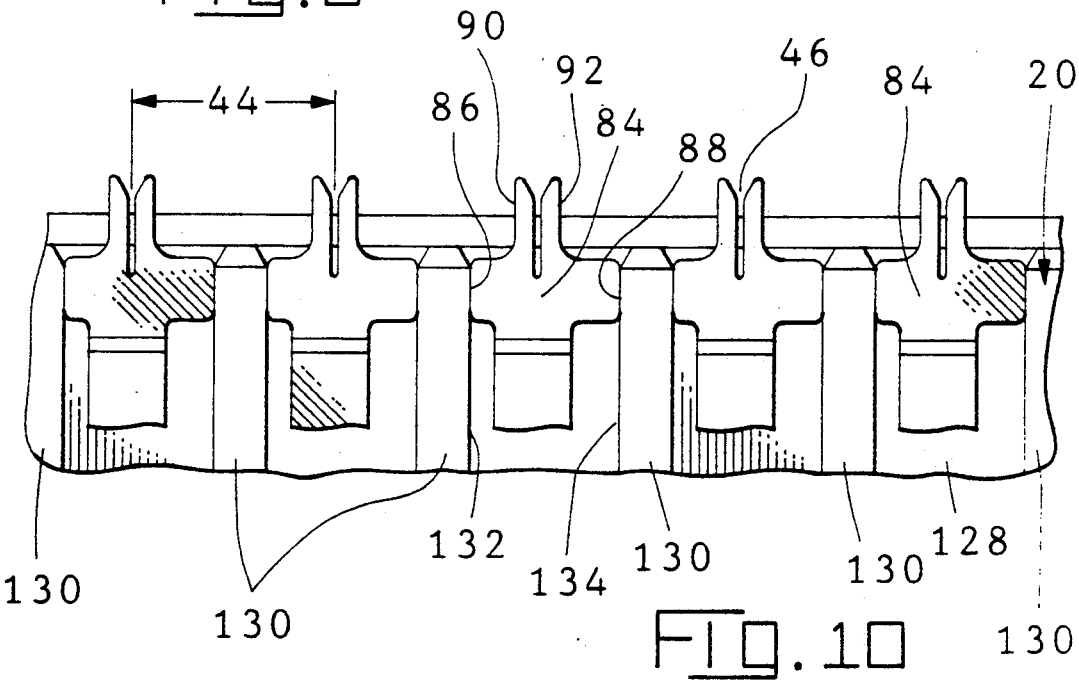
FIG. 10 is a partial sectional view showing the insulation displacement plates of a row of contacts received in the housing.

As best sen in FIG. 10, base region 84 of insulation displacement plate 38 is received in a channel 128 defined by ribs 130 Sidewalls 132,134 of ribs 130 define therebetween a space substantially the same as the distance between shear edges 86,88 of base region 84. Thus, when contact 32 is received in passage 30, with base region 84 received between ribs 130, shear edges 86,88 are positioned against sidewalls 132,134 so as to precisely position insulation displacement plate 38, tines 92 and slot 46 in connector 20, as well as to prevent plate 38, tines 92 and slot 46 from moving laterally during termination of cable 82.

The spacing between the tines of back-to-back contacts in the two rows of inside contacts, as seen in FIGS. 1 and 9 and as indicated in FIG. 1, is the minimum distance 136 between any two points of any features of any two contacts in connector 20. All features of contacts are separated by at least this minimum distance. With reference to FIG. 1, the depth of notches generating sheared surfaces 106 and 114 are selected to maintain at least the minimum spacing 136 between the respective sheared surfaces and the closest feature on a contact received in an opposing channel 128. The location of shoulder 116 is selected relative to the forward edge 111 to be at least the minimum spacing 136. The location of shoulder 104 is selected relative to the forward edge 119 to be at least the minimum spacing 136. In the above manner, a high density connector is provided that maintains at least a minimum distance through air between all features on any one contact and any features on other nearby contacts to minimize the potential of arcing between contacts such that signal voltages carried on the contacts can reach a voltage level that is practical for using the connector. In the preferred embodiment, this minimum air spacing is about 0.025 inch (0.635 mm).

Housing 22 has a terminating cover 24 securable thereto for effecting mass termination for ribbon cable 82 or maintaining ribbon cable 82 in the terminated position. Any known terminating cover will suffice. One such terminating cover is disclosed in copending application Ser. No. 07/304,046 filed Jan. 30, 1989 entitled "Strain Relief for Ribbon Cable Connector," the disclosure of which is hereby incorporated by reference.

Connector 20 is shown in FIG. 1 as a shielded, panel mount connector. The mating end of connector 20 is surrounded by a drawn shell 138 which is electrically commoned with a die cast housing 140 in accordance with the teaching of U.S. Pat. No. 4,808,125, the disclosure of which is hereby incorporated by reference. Drawn shell 138 extends through an aperture 142 in panel 144 and is secured thereto.

We claim:

1. An electrical connector, comprising:

a dielectric housing having a mating face, a terminating face and a plurality of contact receiving passages extending therebetween, said housing having major and minor dimensions transverse to said passages, said housing having at least one row of contact receiving passages along the major dimension; and at least first and second contacts received in adjacent ones of said plurality of passages in said at least one row, each of said first and second contacts having a mating portion on a first end, a conductor terminating portion on a second end and an intermediate portion between said ends, said mating portion and a first section of said intermediate portion being substantially planar, said conductor terminating portion and a second section of said intermediate portion being substantially planar and formed to be substantially perpendicular to said mating portion and the first section of said intermediate portion, said intermediate portion defining an insertion shoulder facing said conductor terminating portion along an edge most distant from said mating portion, said first contact having a respective said insertion shoulder positioned a first predetermined distance from respective said conductor terminating portions, said second contact having a respective said insertion shoulder positioned a second predetermined distance from a respective said conductor terminating portion, said second distance being less than said first distance, the insertion shoulder of said first and second contacts overlapping in a direction transverse to said at least one row thereby occupying a common tool insertion line, said first and second contacts received in adjacent passages in said row of passages, whereby said first contact can be inserted into a passage of said at least one row by applying a force to the insertion shoulder thereof and subsequently said second contact can be inserted into a passage of said at least one row by a tool applying a force to the insertion shoulder thereof without the tool interfering with the insertion shoulder of the first contact.

2. An electrical connector as recited in claim 1, wherein the conductor terminating portions of said first and second contacts are substantially parallel and the mating portions of said first and second contacts are also substantially parallel.

3. An electrical connector as recited in claim 1, further comprising a notch in said first section of said intermediate portion of said first contact, said notch defining a rearwardly facing edge, said rearwardly facing edge positioned in said first section such that said rearwardly facing edge is at least a predetermined minimum spacing from said second contact.

4. An electrical connector as recited in claim 1, further comprising a notch in the first section of said intermediate portion of said first contact, said notch defining a laterally facing edge, said laterally facing edge positioned in said first section such that said laterally facing edge is at least a predetermined minimum spacing from said second contact.

5. An electrical connector as recited in claim 1, further comprising a notch in the first section of said intermediate portion of said second contact, said notch defining a rearwardly facing edge, said rearwardly facing edge positioned in said first section such that said rearwardly facing edge is at least a predetermined minimum spacing from said first contact.

6. An electrical connector as recited in claim 1, further comprising a notch in said first section of said intermediate portion of said second contact, said notch defining a laterally facing edge, said laterally facing edge positioned in said first section such that said laterally facing edge is at least a predetermined minimum spacing from said first contact.

7. An electrical connector as recited in claim 1, wherein the conductor terminating portion defines a pair of opposed edges, said edges received between a respective pair of ribs in said housing, whereby the position of the conductor terminating portion is prevented from moving laterally during termination of a cable to the connector.

8. An electrical connector as recited in claim 1, wherein the mating portion of said first contact defines an axis through substantially the center of the mating portion and respective first section of the intermediate portion, said insertion shoulder extending on opposite sides of said axis.

9. An electrical connector as recited in claim 1, wherein the mating portion of said second contact defines an axis through substantially the center of the mating portion and respective first section of the intermediate portion, said insertion shoulder extending on opposite sides of said axis.

10. An electrical connector as recited in claim 1, wherein said housing is made from an insulating material having substantially no shrink rate.

11. An electrical connector as recited in claim 10, wherein the insulative material is a liquid crystal polymer.

12. An electrical connector as recited in claim 1, further comprising a second row of contacts having conductor terminating portions, the conductor terminating portion of contacts in said first row spaced at least a predetermined minimum spacing from the conductor terminating portion of contacts in said second row.

13. An electrical connector, comprising:

a dielectric housing having a mating face, a terminating face and a plurality of contact receiving passages extending therebetween with contacts secured therein; and at least first and second contacts of said plurality of contacts having a mating portion on a first end, a conductor terminating portion on a second end and an intermediate portion between said ends, said mating portion and a first section of said intermediate portion being substantially planar, said conductor terminating portion and a second section of said conductor terminating portion and a second section of said intermediate portion being substantially planar and formed to be substantially perpendicular to said mating portion and the first section of said intermediate portion, said intermediate portion defining an insertion shoulder facing said conductor terminating portion, said first and second contacts received in adjacent passages in a row of passages, the insertion shoulder of said first and second contacts overlapping in a direction transverse to an imaginary line drawn between the first and second contacts, the insertion shoulders thereby occupying a common tool insertion line, the conductor terminating portion of said first and second contacts defining a width along a major dimension of the housing, the width of said conductor terminating portions of said first and second contacts overlapping in a profile transverse to the major dimension, a notch in said first section of said intermediate portion of said first contact, said notch defining a rearwardly facing edge, said rearwardly facing edge positioned in said first section such that said rearwardly facing edge is at least a predetermined minimum spacing from said second contact.

14. An electrical connector as recited in claim 13, further comprising said notch defining a laterally facing edge, said laterally facing edge positioned in said first section such that said laterally facing edge is at least a predetermined minimum spacing from said second contact.

15. An electrical connector as recited in claim 13, wherein the mating portion of said first contact defines an axis through the mating portion and respective first section of the intermediate portion, said insertion shoulder extending on both sides of said axis, said insertion shoulder being at least a predetermined minimum spacing from any features on adjacent contacts.

16. An electrical connector as recited in claim 13, wherein the conductor terminating portion defines a pair of opposed edges, said edges received between a respective pair of ribs in said housing.

17. An electrical connector as recited in claim 16, wherein said housing is made from an insulative material having substantially no shrink rate.

18. An electrical connector as recited in claim 17, wherein the insulative material is a liquid crystal polymer.

19. An electrical connector, comprising:

a dielectric housing having a mating face, a terminating face and a plurality of contact receiving passages extending therebetween with contacts secured therein; and at least first and second contacts of said plurality of contacts having a mating portion on a first end, a conductor terminating portion on a second end and an intermediate portion between said ends, each of said intermediate portions defining an insertion shoulder facing said conductor terminating portion, the insertion shoulder of said first and second contacts overlapping in a direction transverse to an imaginary line drawn between the first and second contacts, the insertion shoulders thereby occupying a common tool insertion line, the conductor terminating portion of said first and second contacts defining a width along a major dimension of the housing, the width of said conductor terminating portions of said first and second contacts overlapping in a profile transverse to the major dimension, said first contact having a respective said insertion shoulder positioned a first predetermined distance from a respective said conductor terminating portion, said second contact having a respective said insertion shoulder positioned a second predetermined distance from a respective said conductor terminating portion, said second distance being less than said first distance, said first and second contacts received in adjacent passages in a row of passages, whereby said first contact can be inserted into a passage by applying a force to the insertion shoulder thereof and subsequently said second contact can be inserted into a passage by a tool applying a force to the insertion shoulder thereof without the tool interfering with the insertion shoulder of the first contact.

20. An electrical connector, comprising:

a dielectric housing having a mating face, a terminating face and a plurality of contact receiving passages extending therebetween, said housing having major and minor dimensions transverse to the contact receiving passages, said housing having at least one row of contact receiving passages along the major dimensions; and at least first and second contacts received in respective ones of said passages in said at least one row, each of said first and second contacts defining a length and having a mating portion on a first end, a conductor terminating portion on a second end and an intermediate portion between said ends, said mating portion and a first section of said intermediate portion being substantially planar, said conductor terminating portion and a second section of said intermediate portion being substantially planar and formed to be substantially perpendicular to said mating portion and the first section of the intermediate portion, said intermediate portion defining an insertion shoulder facing said conductor terminating portion along an edge most distant from said mating portion, the insertion shoulder of said first and second contacts overlapping in a direction transverse to said at least one row thereby occupying a common tool insertion line, the insertion shoulder of one of said first and second contacts being positioned along the length thereof more forward than the insertion shoulder of the other of said first and second contacts along the length thereof, said first and second contacts received in adjacent passages in said row of passages, whereby one of said contacts can be inserted into a passage of said at least one row by a tool applying a force to the insertion shoulder thereof and subsequently the other contact can be inserted into an adjacent passage in said at least one row of passages by a tool applying a force to the insertion shoulder thereof without the tool engaging the insertion shoulder of the already inserted contact.

21. An electrical connector as recited in claim 20, wherein alternate contacts in said at least one row of contacts have respective insertion shoulders that are positioned along the length thereof more forward than the insertion shoulder of the remaining contacts.

22. An electrical connector as recited in claim 20, further comprising a notch in said first section of said intermediate portion of said first contact, said notch defining a rearwardly facing edge, said rearwardly facing edge positioned in said first section such that said rearwardly facing edge is at least a predetermined minimum spacing from said second contact.

23. An electrical connector as recited in claim 20, further comprising a notch in the first section of said intermediate portion of said first contact, said notch defining a laterally facing edge, said laterally facing edge positioned in said first section such that said laterally facing edge is at least a predetermined minimum spacing from said second contact.

24. An electrical connector as recited in claim 20, further comprising a notch in the first section of said intermediate portion of said second contact, said notch defining a rearwardly facing edge, said rearwardly facing edge positioned in said first section such that said rearwardly facing edge is at least a predetermined minimum spacing from said first contact.

25. An electrical connector as recited in claim 20, further comprising a notch in said first section of said intermediate portion of said second contact, said notch defining a laterally facing edge, said laterally facing edge positioned in said first section such that said laterally facing edge is at least a predetermined minimum spacing from said first contact.

26. An electrical connector as recited in claim 20, wherein the at least first and second contacts are of substantially the same length.

27. An electrical connector as recited in claim 26, wherein alternate contacts in said at least one row of contacts have respective insertion shoulders that are spaced respectively first and second predetermined distances from respective conductor terminating portions.

28. An electrical connector, comprising:

a dielectric housing having a mating face, a terminating face and a plurality of contact receiving passages extending therebetween, said housing having major and minor dimensions transverse to said passages, said housing having a row of contact receiving passages along the major dimension; and first and second contacts received in adjacent ones of said plurality of passages in said row of passages, each of said first and second contacts having a mating portion, a conductor terminating portion and an intermediate portion therebetween, said mating portion and a first section of said intermediate portion being substantially planar, said conductor terminating portion and a second section of said intermediate portion being substantially planar and formed to be substantially perpendicular to said mating portion and the first section of said intermediate portion, said intermediate portion defining an insertion shoulder facing said conductor terminating portion, the insertion shoulder of said first and second contacts overlapping in a direction transverse to said at least one row thereby occupying a common tool insertion line, the conductor terminating portion of said first and second contacts defining respective widths along the major dimension of the housing, the respective widths of said conductor terminating portions of said first and second contacts overlapping in a profile transverse to the major dimension of the housing, said first contact having a respective insertion shoulder positioned a first predetermined distance from a respective conductor terminating portion, said second contact having a respective insertion shoulder positioned a second predetermined distance from a respective conductor terminating portion, said second distance being less than said first distance, said first and second contacts received in adjacent passages in said row, whereby said first contact can be inserted into a passage in said row of passages by applying a force to the insertion shoulder thereof and subsequently said second contact can be inserted into a passage of said row of passages by a tool applying a force to the insertion shoulder thereof without the tool interfering with the insertion shoulder of the first contact.

29. An electrical connector as recited in claim 28, whereby alternate contacts in said row have respective insertion shoulders that are positioned along the length thereof more forward than the insertion shoulders of the remaining contacts.

30. An electrical connector as recited in claim 28, further comprising a notch in said first section of said intermediate portion of said first contact, said notch defining a rearwardly facing edge, said rearwardly facing edge positioned in said first section such that said rearwardly facing edge is at least predetermined minimum spacing from said second contact.

31. An electrical connector as recited in claim 28, further comprising a notch in the first section of said intermediate portion of said first contact, said notch defining a laterally facing edge, said laterally facing edge positioned in said first section such that said laterally facing edge is at least a predetermined minimum spacing from said second contact.

32. An electrical connector as recited in claim 28, further comprising a notch in the first section of said intermediate portion of said second contact, said notch defining a rearwardly facing edge, said rearwardly facing edge positioned in said first section such that said rearwardly facing edge is at least a predetermined minimum spacing from said first contact.

33. An electrical connector as recited in claim 28, further comprising a notch in said first section of said intermediate portion of said second contact, said notch defining a laterally facing edge, said laterally facing edge positioned in said first section such that said laterally facing edge is at least a predetermined minimum spacing from said first contact.

34. An electrical connector as recited in claim 28, wherein the at least first and second contacts are of substantially the same length.

35. An electrical connector as recited in claim 34, wherein alternate contacts in said at least one row of contacts have respective insertion shoulders that are spaced respectively first and second predetermined distances from respective conductor terminating portions.

* * * * *